US006945571B2

(12) United States Patent
Lin

(10) Patent No.: US 6,945,571 B2
(45) Date of Patent: Sep. 20, 2005

(54) PRESSER BAR DEVICE FOR EXIT DOOR

(76) Inventor: Winson Lin, P.O.Box 63-99, Taichung (TW) 406

( * ) Notice: Subject to any disclaimer, the term of this patent is extended or adjusted under 35 U.S.C. 154(b) by 0 days.

(21) Appl. No.: 10/789,639

(22) Filed: Feb. 25, 2004

(65) Prior Publication Data

US 2005/0184531 A1 Aug. 25, 2005

(51) Int. Cl.[7] ..... E05B 65/10

(52) U.S. Cl. ..... 292/92; 292/21; 292/34; 292/156; 292/DIG. 55

(58) Field of Search ..... 292/92–93, 21, 292/34–36, 5–6, 41, 71, 63, 68, 156, DIG. 55

(56) References Cited

U.S. PATENT DOCUMENTS 3,123,387 A * 3/1964 Jackson et al. ..... 292/21
3,819,213 A * 6/1974 Vanderburgh ..... 292/21
4,387,917 A * 6/1983 Cocker ..... 292/40
4,961,330 A * 10/1990 Evans ..... 292/92
5,088,786 A * 2/1992 Linder ..... 292/92
5,114,192 A * 5/1992 Toledo et al. ..... 292/21
5,702,134 A * 12/1997 Hsieh ..... 292/92
5,816,017 A * 10/1998 Hunt et al. ..... 292/92
6,000,733 A 12/1999 Linder ..... 292/92
6,641,183 B2 * 11/2003 Brown ..... 292/92

* cited by examiner

*Primary Examiner*—Daniel P. Stodola
*Assistant Examiner*—Christopher Boswell
(74) *Attorney, Agent, or Firm*—Charles E. Baxley

(57) ABSTRACT

An exit door includes a door panel attached to a door frame and having a presser bar device attached to a stile, to selectively open and lock the door panel to the door frame. The presser bar device includes two lock rods to selectively move into the door frame, a drive pin attached to either of the lock rods, a bracket slidably received in a housing and having a space formed by a hook to engage with the drive pin. A crank is pivotally attached to the housing and has one end coupled to the bracket, a presser bar is carried on the door panel and actuatable onto the other end of the crank, to rotate the crank relative to the housing, and to move the drive pin up and down relative to the housing.

14 Claims, 9 Drawing Sheets

PRESSER BAR DEVICE FOR EXIT DOOR

BACKGROUND OF THE INVENTION

1. Field of the Invention

The present invention relates to a presser bar device for exit door, and more particularly to a presser bar device for attaching to an exit door and having a simplified configuration.

2. Description of the Prior Art

Typical presser bar devices have been developed for being attached to exit doors, to allow people to easily actuate the exit doors and to escape out through the exit doors.

For example, U.S. Pat. No. 6,000,733 to Linder discloses one of the typical presser bar devices, and comprises a crank to be actuated or depressed by a presser bar, in order to actuate a pair of connector bars to move a pair of lock rods, so as to control the opening of the exit door.

However, the crank is useful for allow the typical presser bar devices to be attached to one side of the exit door only, but may not be attached to the other side of the exit door.

For allowing the typical presser bar devices to be attached to the other side of the exit door, a different designed or shaped crank member is further required to be provided and changeably attached to the typical presser bar devices. In addition, the different designed or shaped crank member is required to be attached to different position of the housing.

The present invention has arisen to mitigate and/or obviate the afore-described disadvantages of the conventional presser bar devices for exit doors.

SUMMARY OF THE INVENTION

The primary objective of the present invention is to provide a presser bar device for exit door including a simplified configuration for allowing the presser bar device to be easily attached to opposite sides of the exit door without additional crank.

In accordance with one aspect of the invention, there is provided an exit door comprising a door frame, a door panel attached to the door frame and openable and closeable relative to the door frame, and the door panel including a stile, and a presser bar device attached to the stile of the door panel, to selectively open and lock the door panel to the door frame, the presser bar device including two lock rods slidably attached to the stile to selectively move into the door frame, and thus to selectively open and lock the door panel to the door frame. The presser bar device includes a housing attached to the stile of the door panel and having an oblong hole formed therein, and includes a drive pin attached to either of the lock rods and slidably received in the oblong hole of the housing, and includes a bracket slidably received in the housing and having a space formed therein and defined by a hook to receive the drive pin and to engage the hook with the drive pin. The presser bar device further includes a crank pivotally attached to the housing and having a first end coupled to the bracket and having a second end, and a presser bar carried on the door panel and actuatable onto the second end of the crank, to rotate the crank relative to the housing, and to move the drive pin up and down relative to the housing, in order to actuate the lock rods away from the door frame and to unlock the door panel relative to the door frame, the presser bar device includes means for biasing the lock rods to engage into the door frame, and to selectively lock the door panel to the door frame, and the crank is provided to allow the presser bar device to be attached to either side of the door panel.

The presser bar includes a presser member extended therefrom to engage with and to actuate the second end of the crank. The presser bar device includes two casings attached to the lock rods respectively, to selectively engage into the door frame. Each of the casings includes a space defined between two ears, and a first flap received in the space of the casing.

The first flap includes an orifice formed therein, and a first pole attached to the casing and loosely engaged through the orifice of the first flap to loosely attach the first flap to the casing.

One or more second flaps may further be provided and received in the space of the casing. The second flap includes an orifice formed therein to loosely receive the first pole, and to attach the second flap to the casing. The second flap is arranged to be partially extended out of the casing.

The second flap includes at least one inclined surface, and each of the ears of the casing includes at least one inclined surface. The inclined surface of the second flap includes an inclination different from that of the inclined surface of the ears of the casing.

The first flap includes a channel formed therein, and a second pole attached to the casing and loosely engaged through the channel of the first flap to loosely attach the first flap to the casing. The first flap is also arranged to be partially extended out of the casing.

The first flap includes at least one inclined surface, and each of the ears of the casing includes at least one inclined surface. The inclined surface of the first flap includes an inclination different from that of the inclined surface of the ears of the casing. A spring member may further be provided for biasing the first flap out of the casing.

The door frame includes an aperture formed therein, the door panel includes a passage formed therein to slidably receive the casings, and two shields slidably attached thereto and each having an orifice selectively aligned with the passage of the door panel, and means for biasing the shield relative to the door panel to selectively offset the orifice of the shield from the passage of the door panel, and to engage the shield with the casing.

The door frame includes an actuator attached thereto for selectively engaging with the shield, to move the shield against the biasing means. The door frame includes a board secured thereto and having an opening formed therein and aligned with the aperture thereto to selectively receive the casings.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
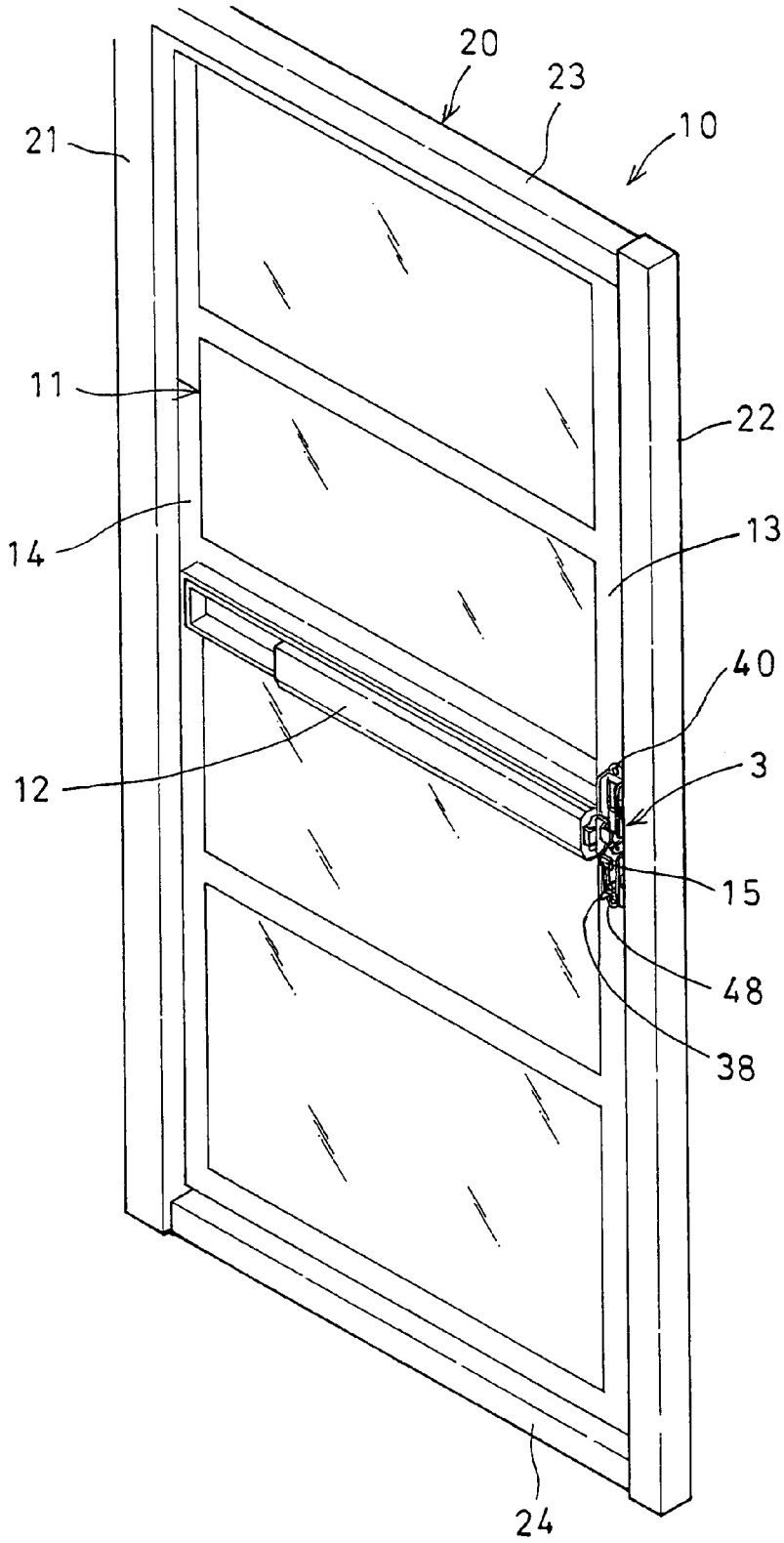
FIG. 1 is a perspective view of an exit door having a presser bar device in accordance with the present invention.
Figure 2:
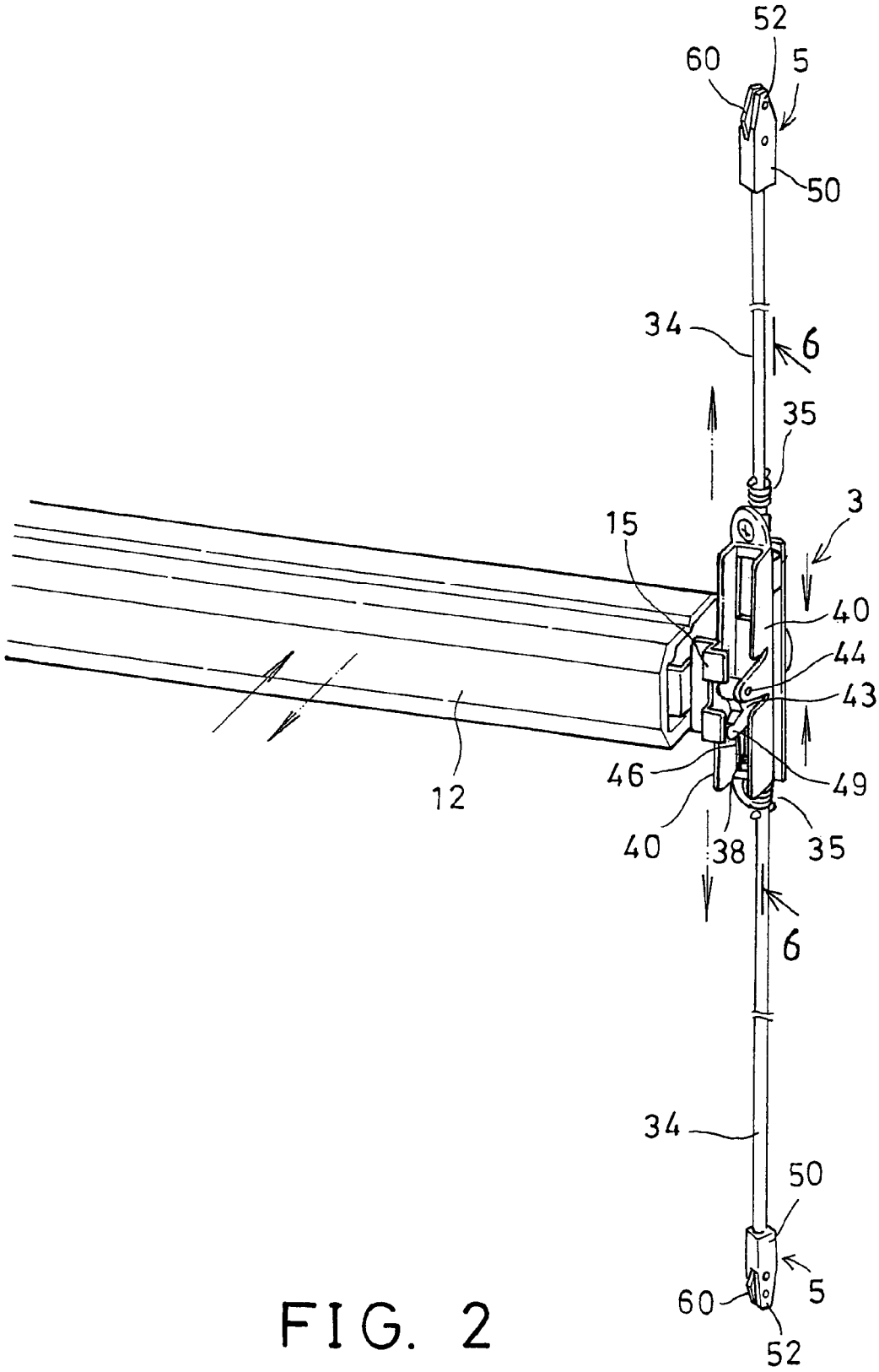
FIG. 2 is a partial perspective view of the presser bar device for the exit door.
Figure 3:
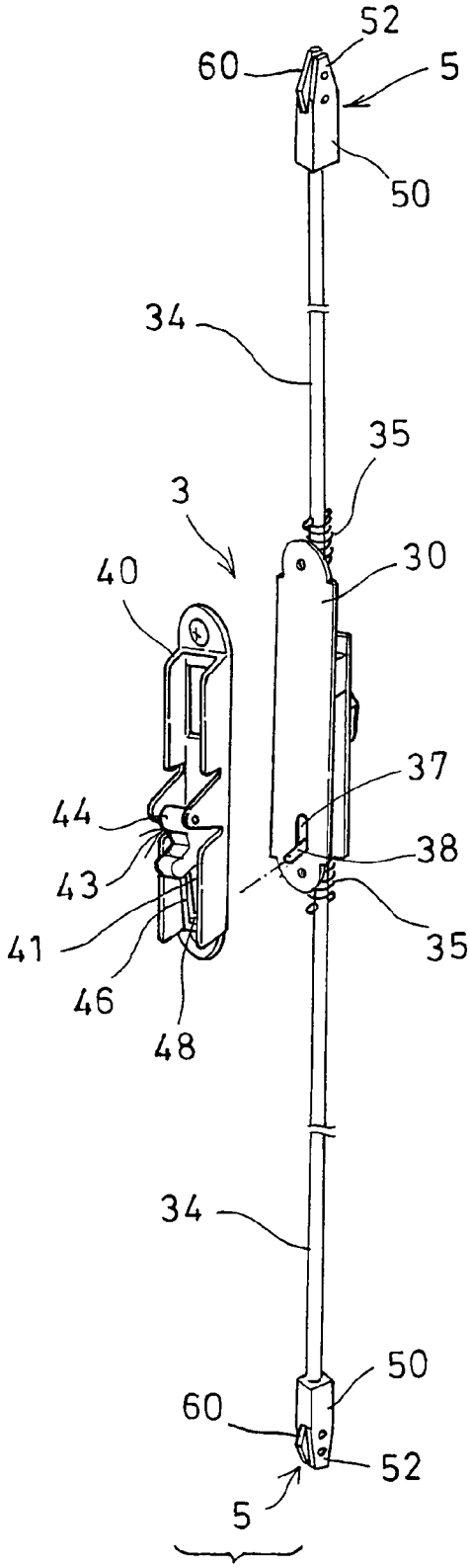
FIG. 3 is a partial exploded view of the presser bar device for the exit door.
Figure 5:
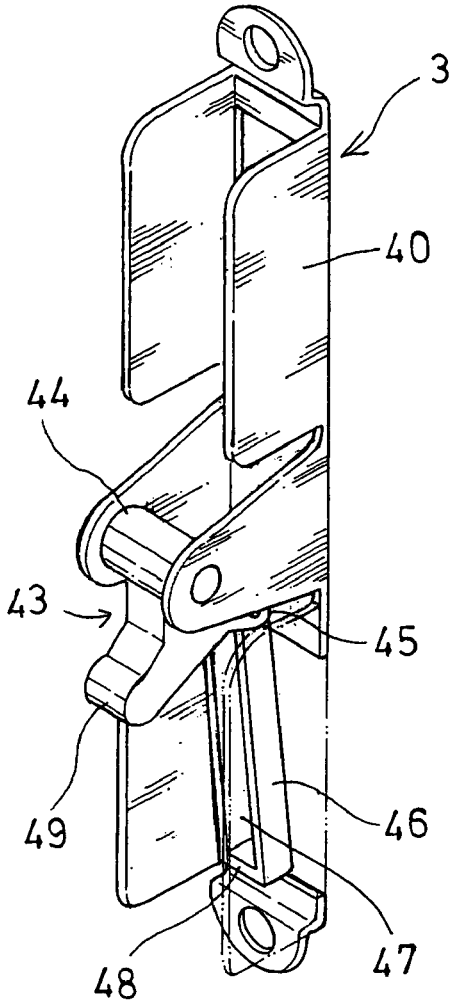
FIG. 5 is an enlarged partial perspective view of the presser bar device for the exit door.
Figure 6:
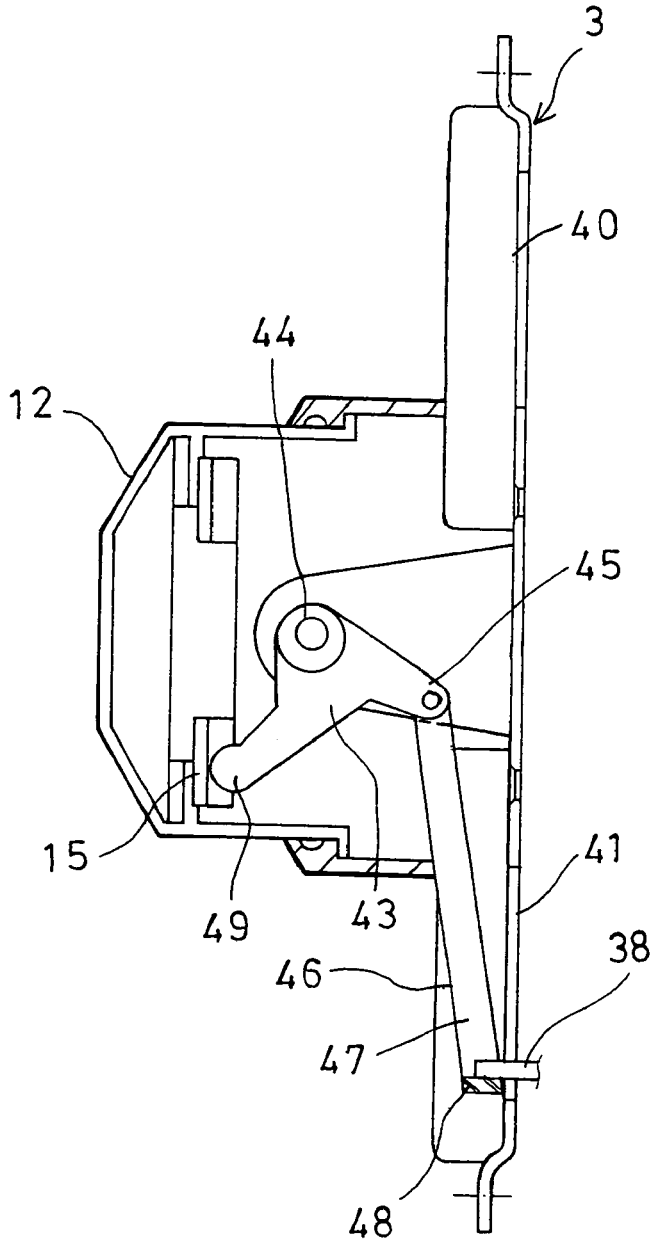
FIG. 6 is a partial cross sectional view of the presser bar device for the exit door, taken along lines 6—6 of FIG. 2.

Referring to the drawings, and initially to FIGS. 1–3, an exit door 10 in accordance with the present invention comprises a door panel 11 pivotally attached in a door frame 20 which includes two side posts 21, 22 and an upper and a lower rails 23, 24. The door panel 11 includes a presser bar 12 carried thereon, and includes a pair of opposite stiles 13, 14.

Figure 4:
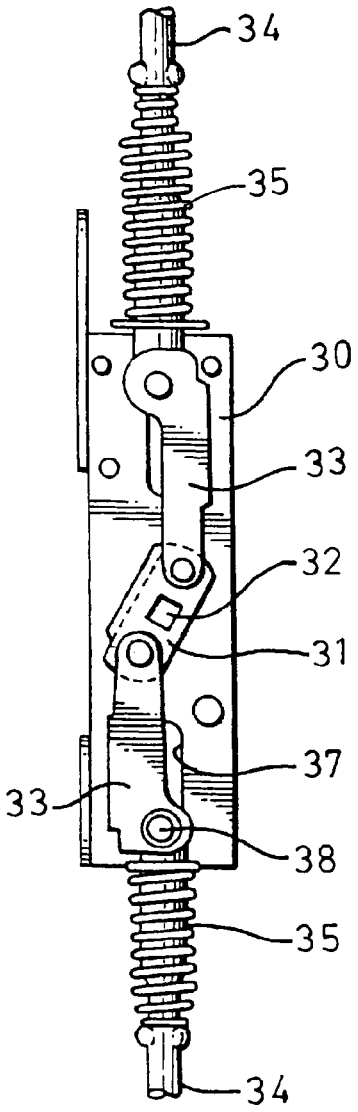
FIG. 4 is a partial rear plan view of the presser bar device for the exit door.

As shown in FIGS. 3–4, a presser bar device 3 includes a plate 30 attached to one of the stiles 13 of the door panel 11, a bar 31 rotatably attached to the plate 30 with an axle 32, and pivotally coupled to two links 33, and two lock rods 34 pivotally coupled to the links 33, and two springs 35 attached onto the lock rods 34 and engaged with the plate 30 for biasing or recovering the lock rods 34 respectively.

The plate 30 includes an oblong hole 37 formed therein (FIGS. 3, 4), and a drive pin 38 attached to one of the links 33 and/or the lock rods 34 and slidably received or engaged in the oblong hole 37 of the plate 30. As shown in FIGS. 2–3 and 5–9, the presser bar device 3 further includes a housing 40 also attached to the one stile 13 of the door panel 11, and also includes an oblong hole 41 formed therein to slidably receive the drive pin 38. The above-identified configuration is typical and will not be described in further details.

A crank 43 includes a middle portion rotatably or pivotally attached to the housing 40 with a pivot axle 44, and includes one end 45 pivotally coupled to a U-shaped bracket 46 which includes a space 47 formed therein and defined by a hook 48. The drive pin 38 is extendible into the space 47 of the bracket 46 and engageable with the hook 48 which may move the drive pin 38 up and down along the oblong hole 41 of the housing 40 and the oblong hole 37 of the plate 30 (FIGS. 5–9).

The crank 43 includes another end 49 to be depressed or actuated by the presser bar 12. The presser bar 12 may be directly engaged onto or actuated onto the other end 49 of the crank 43, or may include a presser member 15 extended therefrom for engaging with and for actuating onto the other end 49 of the crank 43 (FIGS. 6–11), in order to rotate the crank 43, and then to actuate the bracket 46 and the drive pin 38 up and down relative to the housing 40 and the plate 30.

Figure 8:
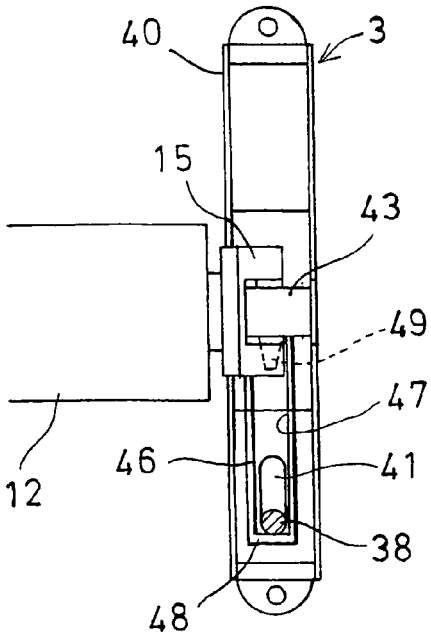
FIG. 8 is a partial front plan view of the presser bar device.
Figure 7:
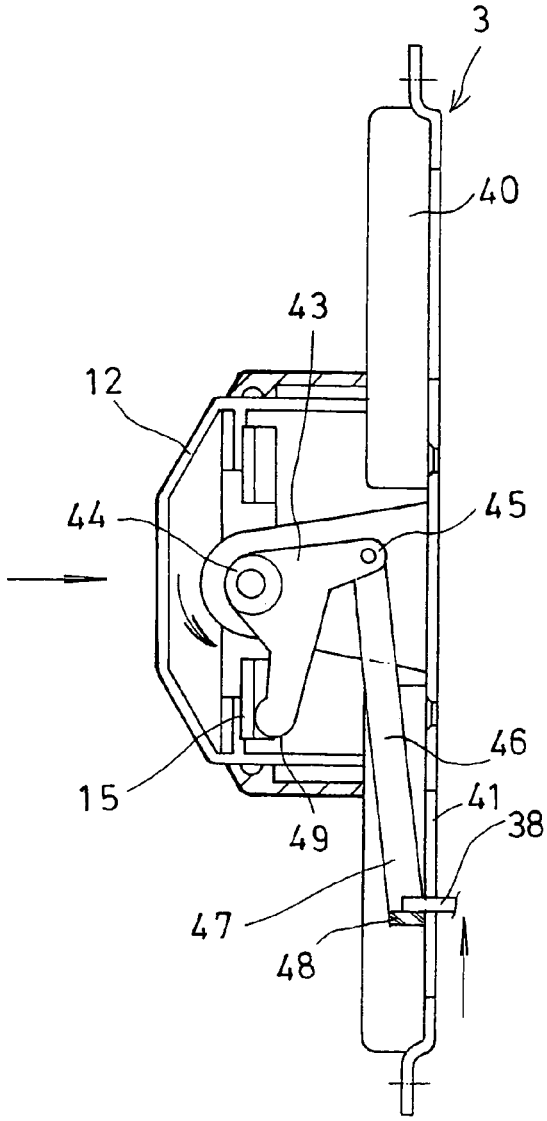
FIG. 7 is a partial cross sectional view similar to FIG. 6, illustrating the operation of the presser bar device for the exit door.
Figure 9:
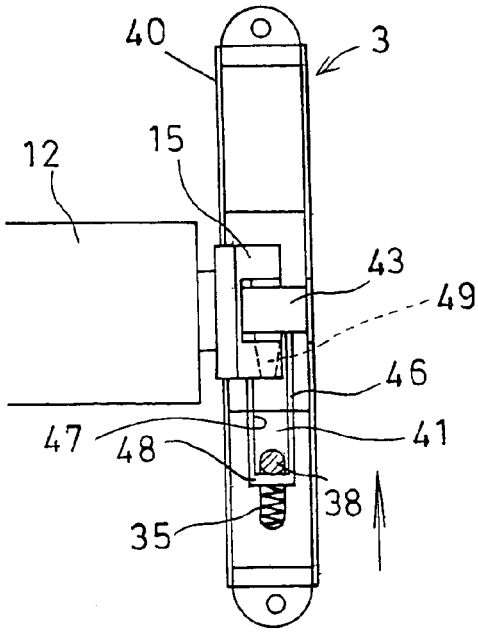
FIG. 9 is a partial front plan view similar to FIG. 8, illustrating the operation of the presser bar device for the exit door.
Figure 10:
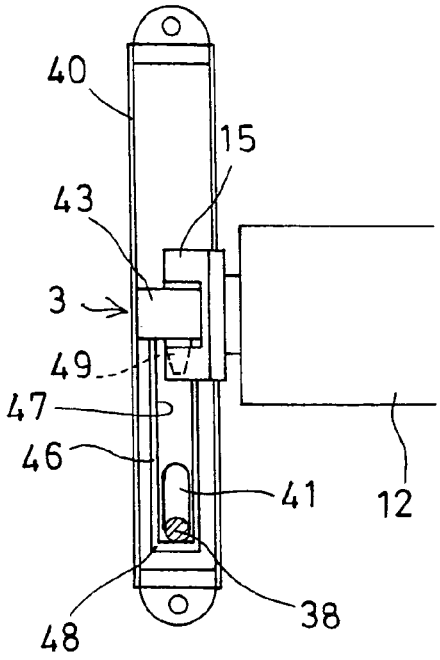
FIGS. 10, 11 are partial front plan views similar to FIGS. 8 and 9 respectively, illustrating the application of the presser bar device attached to the opposite side of the exit door.
Figure 11:
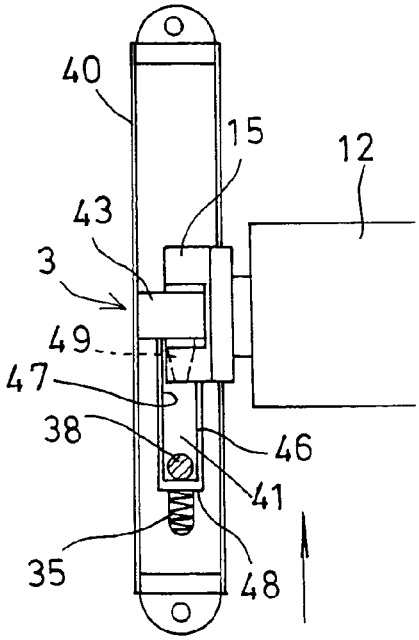
Figure 12:
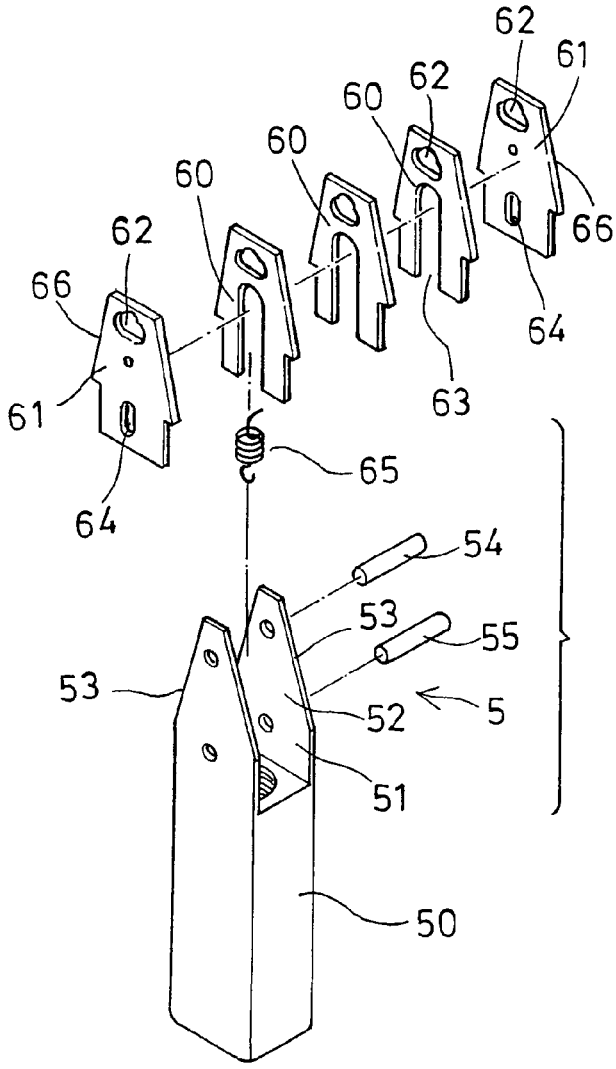
FIG. 12 is another partial exploded view of the presser bar device.

As shown in FIGS. 8 and 9, the plate 30 and the links 33 and the lock rods 34 and the housing 40 and the crank 43 of the presser bar device 3 may be attached to one side, such as the right side of the door panel 11, or to the stile 13 located at the right side of the door panel 11. As shown in FIGS. 10 and 11, the same crank 43 and the other elements of the presser bar device 3 may also be easily attached to the other side, such as the left side of the door panel 11, or to the other stile 14 located at the left side of the door panel 11.

Referring next to FIGS. 12–16, and again to FIGS. 2 and 3, a latch device 5 is attached to the free end portion of each of the lock rods 34, and includes a casing 50 threaded or secured to the respective lock rod 34. Each of the casings 50 includes a space 51 formed in one end thereof and defined between two ears 52. Each of the ears 52 includes a pair of opposite inclined surfaces 53 formed therein. Two poles 54, 55 are engaged through the ears 52 and straddled or engaged through the space 51 of the casing 50.

Figure 14:
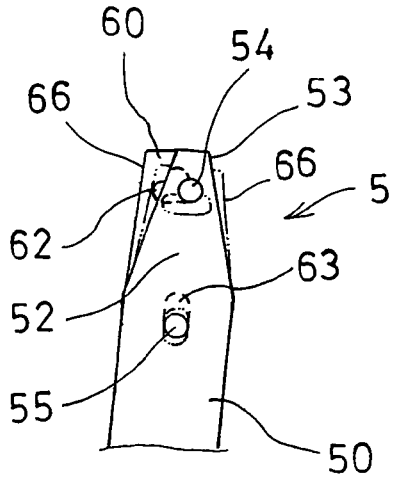
FIG. 14 is a partial side plan view of the presser bar device as shown in FIGS. 12 and 13.
Figure 13:
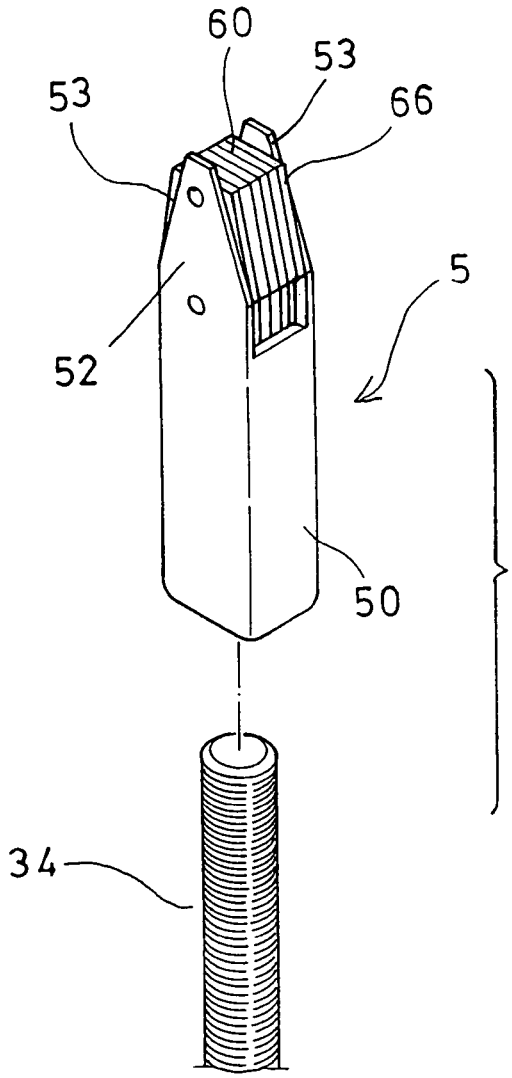
FIG. 13 is a further partial exploded view of the presser bar device.

One or more flaps 60, 61 are further provided and disposed in the space 51 of the casing 50, and each includes an orifice 62 formed therein and having an inner diameter greater than that of the pole 54, to loosely receive the pole 54 therein, and thus to loosely attach the flaps 60, 61 to the casing 50. Each of the intermediate flaps 60 includes a channel 63 formed therein, and each of the outer flaps 61 includes an oblong hole 64 formed therein to receive the other pole 55, and to further loosely attach the flaps 60, 61 to the casing 50, and to allow the flaps 60, 61 to be tilted or inclined relative to the casing 50 (FIG. 14).

One or more springs 65 may be received in the channels 63 of the intermediate flaps 60, and engaged with the intermediate flaps 60 or the pole 55, to bias the flaps 60, 61 upwardly relative to the casing 50. Each of the flaps 60, 61 includes a pair of opposite inclined surfaces 66 formed therein, and having an inclination smaller than that of the inclined surfaces 53 of the housing 50, to allow the flaps 60, 61 to be partially extended out of the space 51 and the ears 52 of the casing 50.

Figure 15:
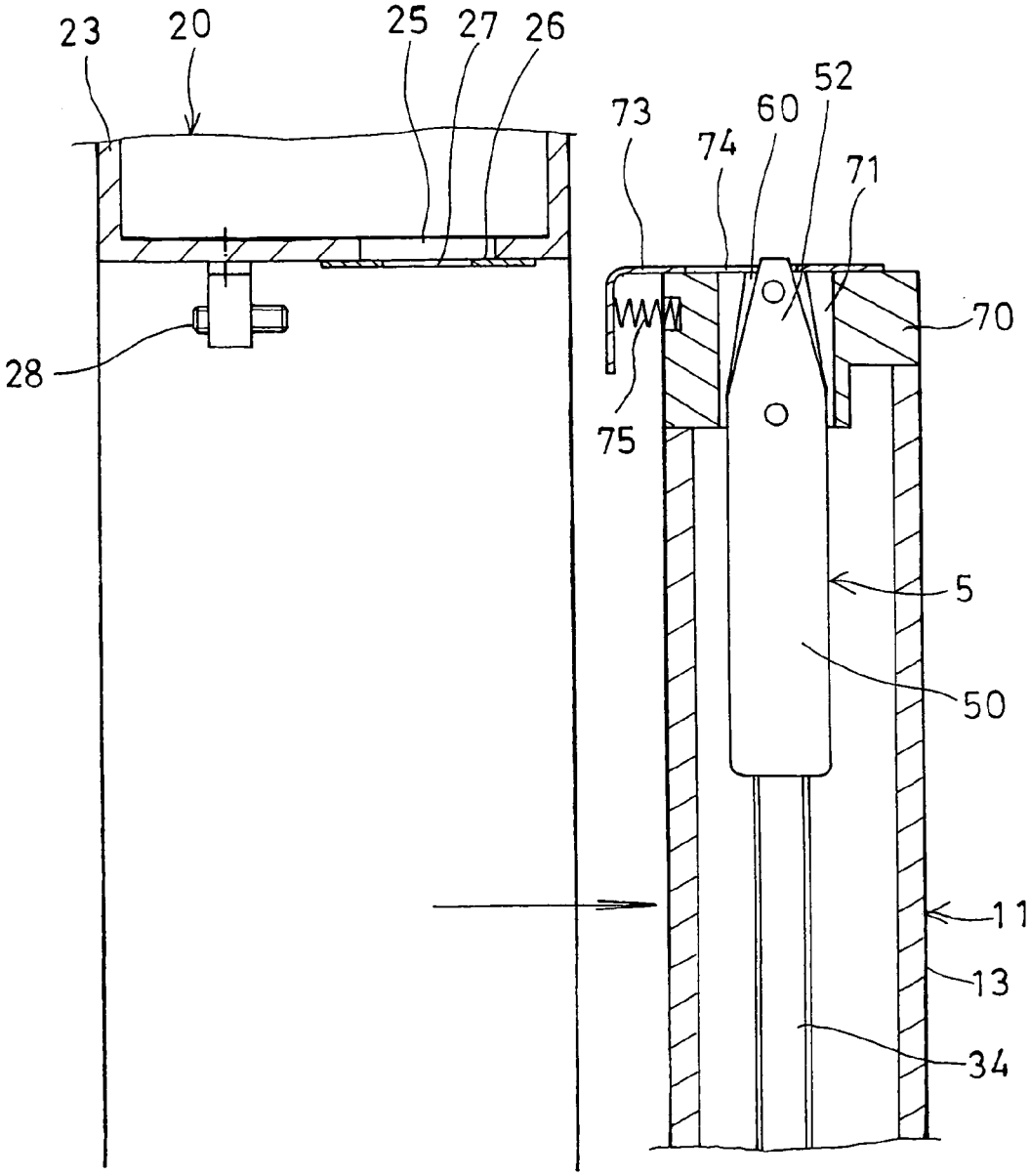
FIGS. 15, 16 are partial cross sectional views illustrating the operation of the presser bar device relative to the exit door.
Figure 16:
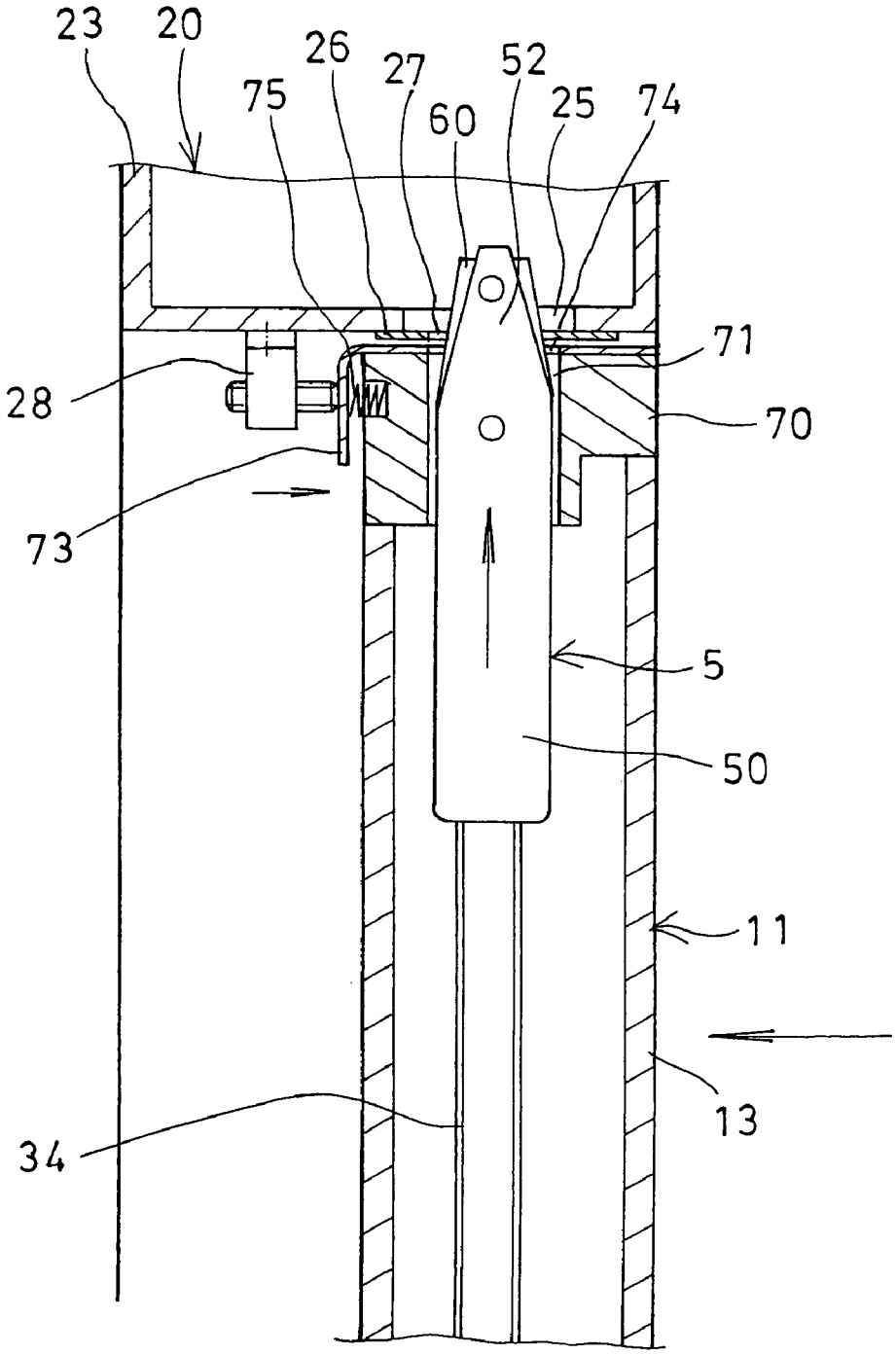

As shown in FIGS. 15, 16, the door frame 20 includes an aperture 25 formed in the upper rail 23, a board 26 secured to the upper rail 23 and having an opening 27 formed therein and aligned with the aperture 25 of the upper rail 23. The opening 27 of the board 26 includes an area or a width or a length smaller than that of the aperture 25 of the door frame 20. An actuator 28 may further be provided and attached to the upper rail 23.

The door panel 11 further includes two blocks 70 attached to the ends of the stile 13 and each having a passage 71 formed therein to slidably receive the casing 50 of the respective latch device 5. Each of the blocks 70 includes a slidable shield 73 attached thereto and having an orifice 74 to be selectively aligned with the passage 71 thereof. A spring 75 may be engaged between the slidable shield 73 and the block 70 to bias or to offset the orifice 74 of the slidable shield 73 relative to the passage 71 of the block 70.

In operation, as shown in FIG. 15, when the door panel 11 is opened relative to the door frame 20, the shield 73 may be biased to offset the orifice 74 of the shield 73 from the passage 71 of the block 70. At this moment, the ears 52 of the casings 50 may be extended into or through the orifice 74 of the shield 73, but the flaps 60, 61 may be biased by the springs 35 (FIGS. 2, 3) and/or 65 (FIG. 12) to engage with the board 26, and to prevent the casing 50 of the latch device 5 from being completely engaged into or through the orifice 74 of the shield 73.

As shown in FIG. 16, when the door panel 11 is rotated or closed relative to the door frame 20, the actuator 28 of the door frame 20 may be engaged with the shield 73, to move the shield 73 relative to the door panel 11 against the spring 75, and thus to align the orifice 74 of the shield 73 with the passage 71 of the block 70. At this moment, the flaps 60, 61 may be disengaged from the board 26, to allow the casing 50 and the flaps 60, 61 of the latch device 5 to be biased by the springs 35 (FIGS. 2, 3) and/or 65 (FIG. 12) and to be completely engaged into or through the orifice 74 of the shield 73, and to engage into the aperture 25 of the upper rail 23, so as to lock the door panel 11 to the door frame 20.

The casing 50 and the flaps 60, 61 of the latch device 5 may be forced or pulled to move out of the aperture 25 of the upper rail 23 by the bar 31 and the links 33, to allow the door panel 11 to be opened or unlocked relative to the door frame 20. When the bar 31 and the links 33 are released, the springs 35 (FIGS. 2, 3) and/or 65 (FIG. 12) may bias the casing 50 and the flaps 60, 61 of the latch device 5 toward the shield 26 again, to allow the ears 52 of the casings 50 to be extended into or through the orifice 74 of the shield 73, but to bias the flaps 60, 61 to engage with the board 26, and to prevent the casing 50 of the latch device 5 from being completely engaged into or through the orifice 74 of the shield 73, and thus to allow the door panel 11 to be easily locked to the door frame 20 again.

As shown in FIG. 14, when in emergent circumstances, such as when on fire, the presser bar 12 may not be suitably operated by the users in some circumstances, but the door panel 11 may also be pushed and opened relative to the door frame 20 with a force of about fifty (50) pounds. The provision of the orifices 62 and the channels 63 and the oblong holes 64 in the flaps 60, 61 allows the flaps 60, 61 to be tilted relative to the casing 50, and the inclined surfaces 53, 66 of the casing 50 and the flaps 60, 61 allow the casing 50 and the flaps 60, 61 to be forced away from the upper rail 23 of the door frame 20 against the springs 35, 65.

Accordingly, the presser bar device includes a simplified configuration for allowing the presser bar device to be easily attached to opposite sides of the exit door without additional crank.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exit door comprising:

a door frame, a door panel attached to said door frame and openable and closeable relative to said door frame, and said door panel including a stile, and a presser bar device attached to said stile of said door panel, to selectively open and lock said door panel to said door frame, said presser bar device including two lock rods slidably attached to said stile to selectively move into said door frame, and thus to selectively open and lock said door panel to said door frame, said presser bar device including a housing attached to said stile of said door panel and having an oblong hole formed therein, and including a drive pin attached to either of said lock rods and slidably received in said oblong hole of said housing, and including a bracket slidably received in said housing and having a space formed therein and defined by a hook to receive said drive pin and to engage said hook with said drive pin, said presser bar device further including a crank pivotally attached to said housing and having a first end coupled to said bracket and having a second end, and a presser bar carried on said door panel and actuatable onto said second end of said crank, to rotate said crank relative to said housing, and to move said drive pin up and down relative to said housing, in order to actuate said lock rods away from said door frame and to unlock said door panel relative to said door frame, said presser bar device including means for biasing said lock rods to engage into said door frame, and to selectively lock said door panel to said door frame, said crank being provided to allow said presser bar device to be attached to either side of said door panel, said presser bar device including two casings attached to said lock rods respectively, to selectively engage into said door frame, each of said casings including a space defined between two ears, and including a first flap received in said space of said casing, said first flap including an orifice formed therein, and a first pole attached to said casing and loosely engaged through said orifice of said first flap to loosely attach said first flap to said casing, and at least one second flap received in said space of said casing.

2. The presser bar device as claimed in claim 1, wherein said presser bar includes a presser member extended therefrom to engage with and to actuate said second end of said crank.

3. The presser bar device as claimed in claim 1, wherein said at least one second flap includes an orifice formed therein to loosely receive said first pole, and to attach said at least one second flap to said casing.

4. The presser bar device as claimed in claim 1, wherein said at least one second flap is arranged to be partially extended out of said casing.

5. The presser bar device as claimed in claim 4, wherein said at least one second flap includes at least one inclined surface, and each of said ears of said casing includes at least one inclined surface.

6. The presser bar device as claimed in claim 5, wherein said at least one inclined surface of said at least one second flap includes an inclination different from that of said at least one inclined surface of said ears of said casing.

7. The presser bar device as claimed in claim 1, wherein said first flap is arranged to be partially extended out of said casing.

8. The presser bar device as claimed in claim 7, wherein said first flap includes at least one inclined surface, and each of said ears of said casing includes at least one inclined surface.

9. The presser bar device as claimed in claim 8, wherein said at least one inclined surface of said first flap includes an inclination different from that of said at least one inclined surface of said ears of said casing.

10. The presser bar device as claimed in claim 7 further comprising means for biasing said first flap out of said casing.

11. The presser bar device as claimed in claim 1, wherein said door frame includes an aperture formed therein, said door panel includes a passage formed therein to slidably receive said casings, and two shields slidably attached thereto and each having an orifice selectively aligned with said passage of said door panel, and means for biasing said shield relative to said door panel to selectively offset said orifice of said shield from said passage of said door panel, and to engage said shield with said casing.

12. The presser bar device as claimed in claim 11, wherein said door frame includes an actuator attached thereto for selectively engaging with said shield, to move said shield against said biasing means.

13. The presser bar device as claimed in claim 11, wherein said door frame includes a board secured thereto and having an opening formed therein and aligned with said aperture thereto to selectively receive said casings.

14. An exit door comprising:

a door frame, a door panel attached to said door frame and openable and closeable relative to said door frame, and said door panel including a stile, a presser bar device attached to said stile of said door panel, to selectively open and lock said door panel to said door frame, said presser bar device including two lock rods slidably attached to said stile to selectively move into said door frame, and thus to selectively open and lock said door panel to said door frame, said presser bar device including a housing attached to said stile of said door panel and having an oblong hole formed therein, and including a drive pin attached to either of said lock rods and slidably received in said oblong hole of said housing, and including a bracket slidably received in said housing and having a space formed therein and defined by a hook to receive said drive pin and to engage said hook with said drive pin, said presser bar device further including a crank pivotally attached to said housing and having a first end coupled to said bracket and having a second end, and a presser bar carried on said door panel and actuatable onto said second end of said crank, to rotate said crank relative to said housing, and to move said drive pin up and down relative to said housing, in order to actuate said lock rods away from said door frame and to unlock said door panel relative to said door frame, said presser bar device including means for biasing said lock rods to engage into said door frame, and to selectively lock said door panel to said door frame, said crank being provided to allow said presser bar device to be attached to either side of said door panel, said presser bar device including two casings attached to said lock rods respectively, to selectively engage into said door frame, each of said casings including a space defined between two ears, and including a first flap received in said space of said casing, said first flap including an orifice formed therein, and a first pole attached to said casing and loosely engaged through said orifice of said first flap to loosely attach said first flap to said casing, and said first flap including a channel formed therein, and a second pole attached to said casing and loosely engaged through said channel of said first flap to loosely attach said first flap to said casing.

* * * * *